United States Patent [19]

Luy

[11] 4,051,452

[45] Sept. 27, 1977

[54] ANNULAR RESISTOR

[75] Inventor: William R. Luy, Colgate, Wis.

[73] Assignee: Cutler-Hammer, Inc., Milwaukee, Wis.

[21] Appl. No.: 761,217

[22] Filed: Jan. 21, 1977

Related U.S. Application Data

[63] Continuation of Ser. No. 605,673, Aug. 18, 1975, abandoned.

[51] Int. Cl.[2] ..... H01C 1/08

[52] U.S. Cl. ..... 338/51; 303/20; 338/280; 338/316; 338/319

[58] Field of Search ..... 338/51, 279, 280, 283, 338/287, 315, 316, 318, 319; 219/374, 375, 536; 310/102 R; 105/49, 61; 303/3, 7, 9, 15, 20

[56] References Cited

U.S. PATENT DOCUMENTS

| | | | |
|---|---|---|---|
| 1,388,822 | 8/1921 | Roys | 219/375 |
| 3,074,042 | 1/1963 | McNeir et al. | 338/280 |
| 3,237,142 | 2/1966 | Nuss | 338/280 |
| 3,697,923 | 10/1972 | Griffes | 338/280 |
| 3,858,149 | 12/1974 | Kirilloff | 338/315 X |

*Primary Examiner*—C. L. Albritton

*Attorney, Agent, or Firm*—Hugh R. Rather; William A. Autio; Michael E. Taken

[57] ABSTRACT

An annular resistor, suitable for use in a diesel electric locomotive dynamic braking system and the like, having a supporting frame including spaced inner and outer annular frame portions and a continuous resistance ribbon having a plurality of bent-back radial extensions therebetween and in electrical isolation therefrom. U-shaped folds of the ribbon are mounted on pin supports allowing contraction and expansion of the ribbon. The pin supports are mounted to insulator blocks which may be selectively positioned on the frame, when two or more are stacked, to vary ribbon alignment and hence convective cooling. The resistor is comprised of severally replaceable identical component quadrants.

21 Claims, 9 Drawing Figures

ANNULAR RESISTOR

CROSS REFERENCE TO RELATED APPLICATION

This application is a continuation of my application, Ser. No. 605,673, filed Aug. 18, 1975 now abandoned.

BACKGROUND OF THE INVENTION

Dynamic braking resistors are known in the prior art. These resistors are generally of a rectangular configuration and require separate hatches on the side of the locomotive in addition to radiator fan hatches on top of the locomotive. Furthermore, these prior resistors offer only a single mode of ribbon layer relationship.

SUMMARY OF THE INVENTION

An object of the invention is to provide an improved annular resistor.

Another object of the invention is to provide a resistor of the aforementioned character having a resistance ribbon reflexed to form a plurality of radial extensions.

Another object of the invention is to provide a resistor of the aforementioned character having severally replaceable identical component quadrants.

Another object of the invention is to provide a resistor of the aforementioned character having multiple modes of ribbon layer relationship wherein current carrying inlet and outlet ribbons may be aligned or non-aligned according to choice of insulator block position without any change in the supporting frame to permit, in combination with convoluted ribbon surfaces, the desired degree of turbulated airflow through the resistor thereby increasing convective cooling and air particle scrubbing thereof.

Another object of the invention is to provide a resistor of the aforementioned character having inner and outer frame portions adjustable relative to one another for selecting a desired expansion gap for the ribbon.

Another object of the invention is to provide a resistor of the aforementioned character wherein a component quadrant may be connected in series or parallel with another component quadrant.

A more specific object of the invention is to provide a resistor which may be mounted directly above the radiator fan of a locomotive to be forcibly ventilated thereby.

These and other objects of the invention will become apparent in the following description.

DESCRIPTION OF THE PREFERRED EMBODIMENT

Figure 1:
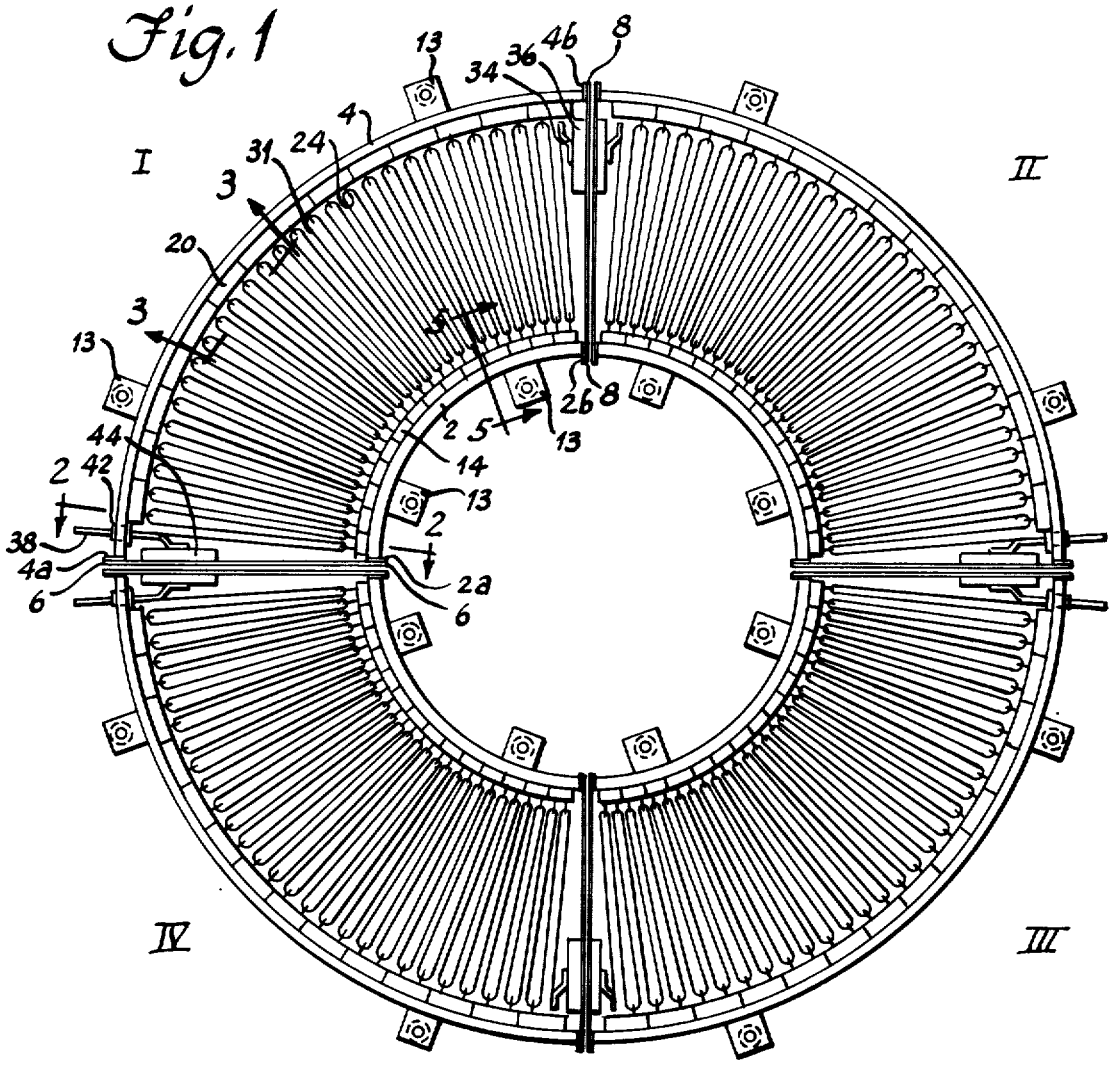
FIG. 1 is a top view of a resistor constructed in accordance with the invention showing the four quadrants slightly separated and inlet and outlet ribbons aligned.

As shown in FIG. 1, the resistor is comprised of four identical interchangeable quadrant sections, I–IV. Only quadrant I will be described in detail because it is interchangeable with any other quadrant by merely flip-flopping it 180° about either of the quadrant axes.

Figure 2:
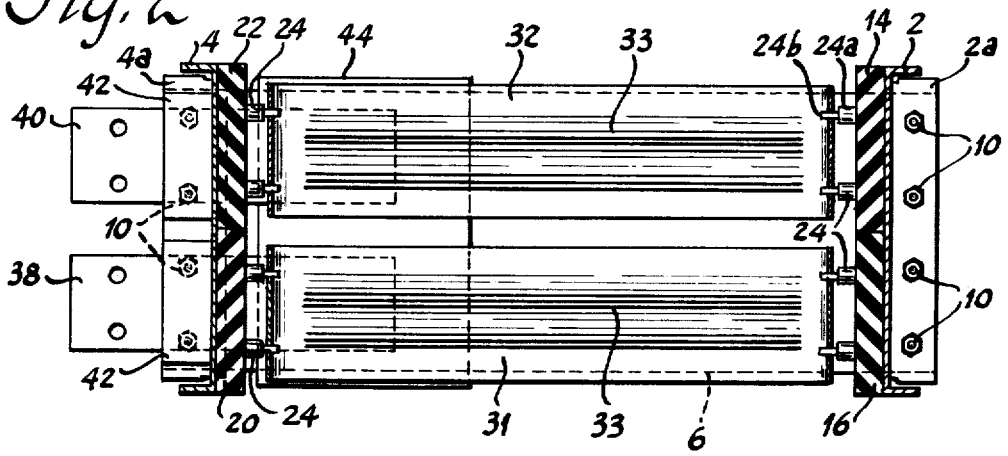
FIG. 2 is a cross-sectional view taken along line 2—2 of FIG. 1.
Figure 5:
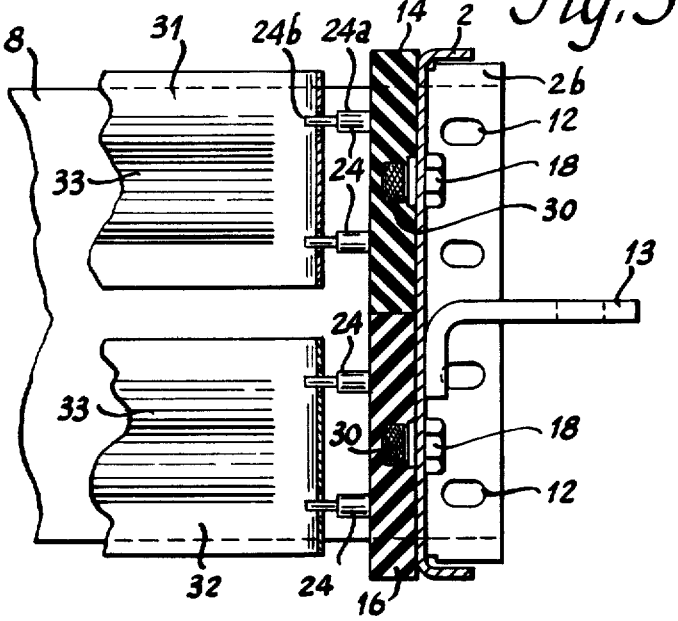
FIG. 5 is a fragmentary cross-sectional view taken along line 5—5 of FIG. 1.

As shown in FIG. 1, there is provided a supporting frame having an inner member 2 and an outer member 4 arcuately extending about a common center in concentric spaced apart relation. These frame members are adjustably attached to end frame members 6 and 8, by means of screws 10, FIG. 2, extending through circular apertures (not shown) in the inner and outer portions of said end members and through elongated apertures 12 in flange portions 4*a* and 4*b* of the outer member and 2*a* and 2*b* of the inner member, as seen in FIGS. 1, 2 and 5. Due to the elongated apertures 12 in the flanges of said inner and outer frame members, the radial distance between said inner and outer frame members can be adjusted by loosening the screws 10, adjusting for the desired ribbon thermal expansion gap, as will be described hereinafter, and re-tightening the screws 10. As seen in FIGS. 1 and 5, mounting brackets 13 are provided along the inner and outer periphery of the frame and attached thereto in any suitable manner. These brackets are so positioned as to enable mounting of the resistor on the top of a locomotive, directly above a radiator fan, each quadrant being individually supported by its own mounting brackets.

Two rows of electrical insulator blocks 14 and 16 are positioned side by side along the inner member 2, each block being secured thereto by means of a bolt 18, as shown in FIGS. 1 and 5. Similarly, there are also provided insulator blocks 20 and 22 along the outer member, as shown in FIGS. 1 and 2. The outer blocks 20 and 22 are wider than the inner blocks 14 and 16 to allow for the cumulative circumferential difference therebetween.

Figure 6:
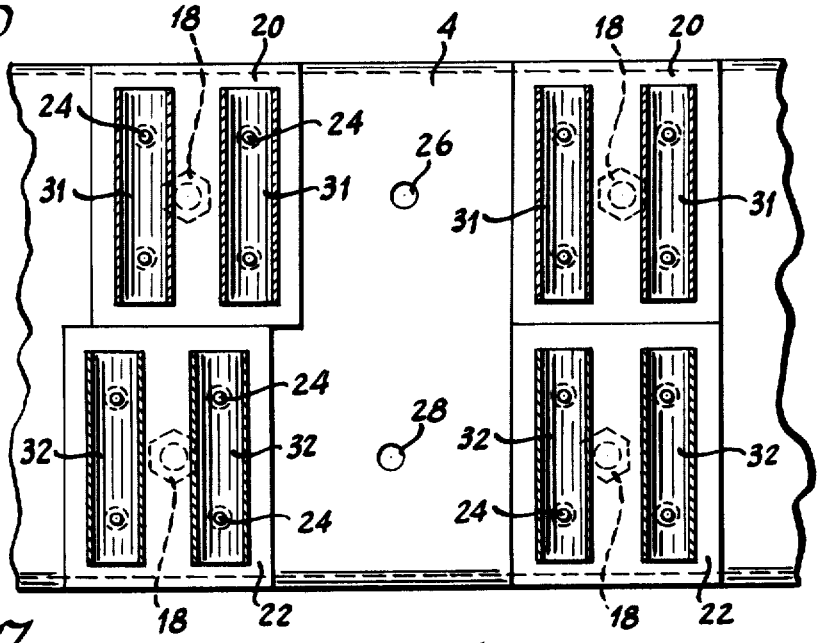
FIG. 6 shows an alternate embodiment of that shown in FIG. 4.

FIG. 6 shows isolated insulator blocks mounted to the member 4. Insulator block 20 is in the upper row of insulator blocks for mounting the outlet ribbon and insulator block 22 is in the lower row of insulator blocks for mounting the inlet ribbon. Circular apertures 26 and 28 are formed in the member 4 in laterally displaced relationship with respect to each other. Insulator block 20 is secured to the frame by means of bolt 18 extending through aperture 26 in the frame and into threaded engagement with an insert 3*c* molded in said insulator block. Insulating block 22 is similarly mounted. Member 2 has apertures formed therein corresponding to apertures 26 and 28, and insulator blocks 14 and 16 are similarly mounted.

Molded into each insulator block are four supporting pins 24 each having a shoulder portion 24*a* and a ribbon mounting portion 24*b*, as shown in FIG. 5. As shown in FIG. 6 these supporting pins define a rectangle within the perimeter of the insulator block. Insert 30 is located slightly off the center-line of block 20 to permit alignment or non-alignment of inlet and outlet ribbons as desired upon 180° rotation of the block about bolt 18, as will hereinafter be more fully described. It is to be noted that blocks 20 and 22 are identical and that blocks 14 and 16, also having offset inserts are likewise identical.

Extending between the inner and outer frame members of quadrant I are two continuous reflexed ribbons, 31 and 32, each forming a plurality of radial extensions joined by U-shaped folds, as shown in FIGS. 1 and 5. Each of the U-shaped folds has two apertures for loosely receiving the ribbon mounting portion **24*b* of the corresponding supporting pin 24, as shown in FIGS. 2 and 6. The ribbon may thermally expand along ribbon mounting portions 24*b*. Shoulder portion 24*a* acts as a stop to insure adequate spacing between the ribbon and the insulator blocks, thus preventing hot spots on the ribbon by insuring adequate air flow therearound. To retain its radial character and to insure proper outward divergence of its radial extensions, the ribbon is formed so that the inner U-shaped folds are specifically reflexed about a radius which is smaller than the radius used for reflexing the outer U-shaped folds. Along each radial extension as shown in FIG. 2 the ribbon is formed with convolutions 33** therein to increase the structural strength and stiffness thereof and to agitate the airflow therearound providing greater convective cooling.

The inlet and outlet ribbons 32 and 31 are electrically connected in series by means of a connector strap 34 having its ends welded to said ribbons and its middle mounted to a insulator 36 which is attached to end frame member 8 in a suitable manner, as seen in FIG. 1. Terminals 38 and 40 shown in FIG. 2 are provided for connection to a traction motor acting as a generator in a dynamic braking system. As shown in FIG. 1, terminal 38 extends through the outer frame member 4, being electrically isolated therefrom by insulative bushing 42, and is mounted to an insulator 44 which is mounted to end frame member 6. Outlet ribbon 31 is electrically connected to terminal 38 and inlet ribbon 32 to terminal 40 in any suitable manner such as by a weld. It will thus be seen that the current path is as follows: terminal 40 to inlet ribbon 32 to connector strap 34 to outlet ribbon 31 to terminal 38.

Each quadrant comprises one-half the resistance required for a traction motor on a single axle of a locomotive. Thus the present resistor, comprising four such quadrants, may replace two of the prior resistors.

As aforementioned, each quadrant is identical. As seen in FIG. 1, quadrant I may replace quadrant II by merely flipflopping quadrant I 180° about end frame member 8, or quadrant I may replace quadrant IV by flip-flopping quadrant I 180° about end frame member 6, etc. This identically replaceable component arrangement is important for reduced number of parts, ease of repair and reduced maintenance costs.

FIG. 6 shows two modes of inlet and outlet ribbon arrangement. In the first mode, the inlet ribbon 32 and the outlet ribbon 31 are non-aligned, i.e. laterally offset. To change to the second mode, wherein the inlet and outlet ribbons are aligned, insulator block 20 is rotated 180° about its insert 30 (and bolt 18) and insulator block 22 is rotated 180° about its bolt, the inner insulator blocks 14 and 16 being similarly rotated, these steps being performed during assembly. FIG. 1 shows inlet and outlet ribbons aligned and hence only outlet ribbon 31 is visible therein. In the ribbon alignment mode of FIG. 6 all of the outer insulator blocks 20 are in-line with the outer insulator blocks 22 and the inner insulator blocks 14 are in-line with the inner insulator blocks 16. In the ribbon non-alignment mode, the outer insulator blocks 20 are staggered with respect to the outer insulator blocks 22 and the inner insulator blocks are similarly staggered with respect to each other. It is to be noted that either of the abovesaid modes may be used without any change in the supporting frame of the resistor because mere insulator block rotation about bolts 18 extending through apertures in the inner and outer frame members accomplishes non-alignment or alignment, as desired, due to the offset insulator block apertures and the non-aligned frame apertures.

It can easily be appreciated that varied positioning of supporting pins 24 and aperture 30 in relation to each other and to the center line of the insulator block can produce multiple variations and alternatives upon rotation of the blocks. It is thus seen that the present invention encompasses the concept of using any eccentric mounting means to accomplish ribbon alignment or non-alignment.

The embodiment depicted in FIG. 6 allows maximum offset of the ribbons. A lesser degree of offset is possible with the embodiment depicted in FIG. 3 wherein the frame apertures **26*a* and 28*a*** are now aligned. Rotation of the blocks produce ribbon alignment or non-alignment.

Figure 4:
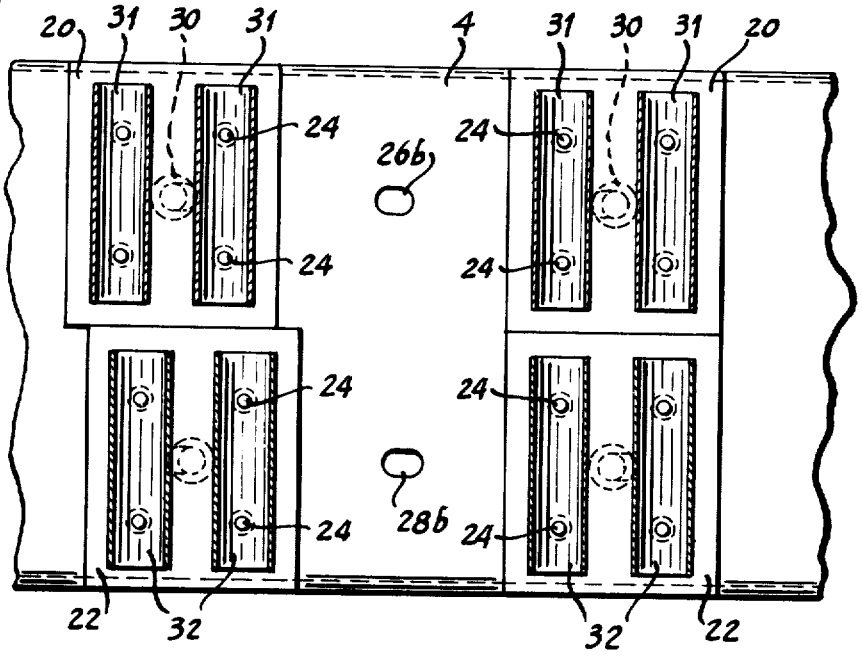
FIG. 4 shows an alternate embodiment of that shown in FIG. 3.

Another alternative is shown in FIG. 4 wherein elongated non-aligned apertures **26*b* and 28*b*** are formed in the frame. Changing ribbon layer mode from non-alignment to alignment is accomplished by sliding the insulator blocks left or right instead of rotating them.

Figure 3:
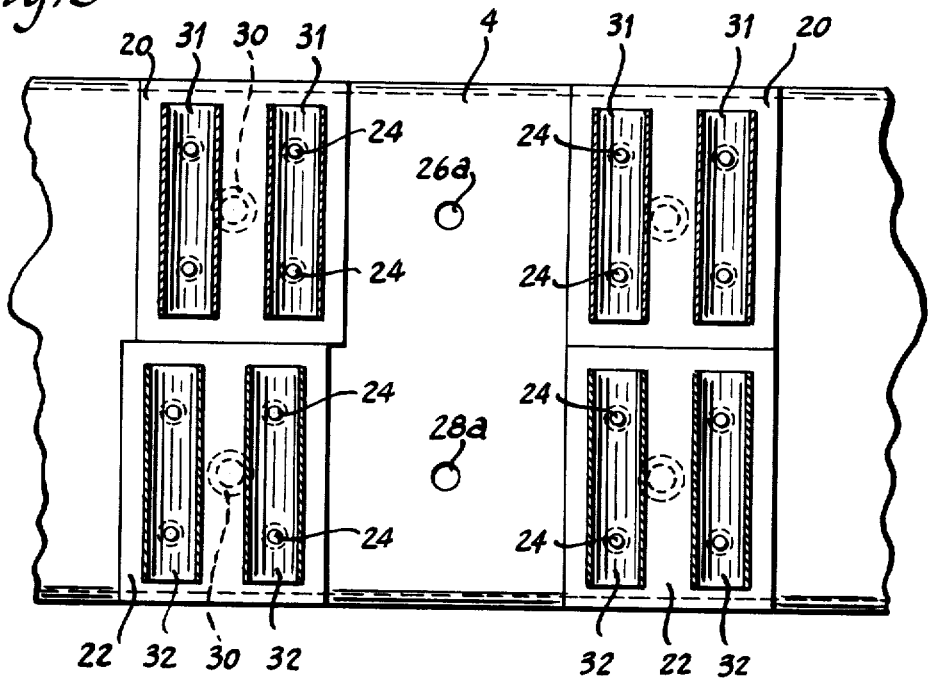
FIG. 3 is a fragmentary view taken along line 3—3 of FIG. 1.

In each of the embodiments, depicted in FIGS. 6, 3 and 4, the inner and the outer insulator blocks can be staggered independently of each other. For example, the inner insulator blocks may be in-line while the outer insulator blocks are staggered, thus producing a semi-offset arrangement of the ribbon wherein the inner U-shaped folds are aligned and the outer U-shaped folds are non-aligned.

The alignment non-alignment options together with the degree of convolutedness of the aforementioned convolutions 33 in the radial extensions of the ribbon control the airflow pattern through the resistor and provide a wide range of possibilities therefor, from a straight-through flow to an acutely agitated flow, to satisfy the desired amount of convective cooling, air particle scrubbing of the ribbon, etc.

Figure 9:
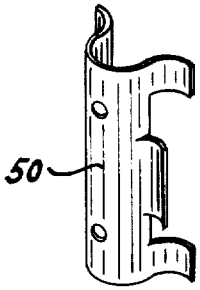
FIG. 9 is an isometric view of an optional air turbulator.
Figure 7:
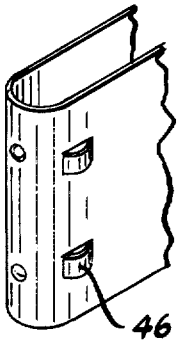
FIG. 7 is an isometric view of a portion of a modified U-shaped ribbon resistor.
Figure 8:
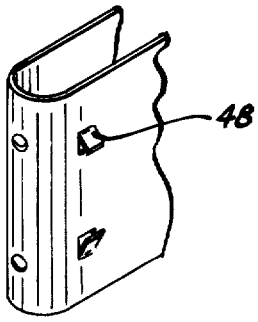
FIg. 8 is a view like FIG. 7 but showing another modified embodiment of a ribbon resistor.

Various modifications in the ribbon near the U-shaped folds may be provided to increase air turbulence and hence heat transfer, such as a sheared bowed protrusion 46 as shown in FIG. 7, and a sheared tab 48 as shown in FIG. 8. There may also optionally be provided an air turbulator 50 having various surfaces to conduct heat away from the ribbon and create greater turbulence therearound as shown in FIG. 9. This air turbulator may be fitted on the end of the U-shaped fold in the ribbon.

I claim:

1. A resistor comprising in combination:

a supporting frame having inner and outer annular portions and portions holding them in spaced apart concentric relationship;

insulating means attached to the opposing faces of said inner and outer annular portions;

a reflexed resistance ribbon means having inner and outer U-shaped bends in proximity to said insulating means and segments connecting and arranged in a radial relation between said inner and outer bends;

support means providing individual support for each of said bends with respect to said insulating means to keep said ribbon means within the annulus defined by opposing faces of said insulating means; and terminal means connected to said ribbon means for connecting the latter to a source of electrical current.

2. A resistor according to claim 1 comprising severally replaceable resistance units cumulatively comprising said resistor, each of said resistance units being independently connectable to a source of electrical current.

3. A resistor according to claim 1 wherein said ribbon means comprises a plurality of ribbon layers, each layer forming an annulus concentric to said inner annular frame portion, and comprising mounting means for said insulating means such that the U-shaped bends of one ribbon layer may be selectively aligned with or offset from the U-shaped bends of another ribbon layer according to orientation of said insulating means with respect to said frame.

4. A resistor comprising in combination:

a supporting frame having inner and outer annular portions and portions holding them in spaced apart concentric relationship;

insulating means attached to the opposing faces of said inner and outer annular portions;

a reflexed resistance ribbon means having inner and outer U-shaped bends in proximity to said insulating means and segments connecting and arranged in a radial relation between said inner and outer bends;

support means attached to said insulating means and providing individual support for each of said bends; and terminal means connected to said ribbon means for connecting the latter to a source of electrical current.

5. A resistor according to claim 4 comprising severally replaceable resistance units cumulatively comprising said resistor, each of said resistance units being independently connectable to a source of electrical current.

6. A resistor according to claim 4 wherein said ribbon means comprises a plurality of ribbon layers, each layer forming an annulus concentric to said inner annular frame portion, and said insulating means comprises a plurality of rows of insulator blocks, one row for each layer.

7. A resistor according to claim 6 comprising eccentric mounting means whereby the U-shaped bends of one ribbon layer may be selectively aligned with or offset from the U-shaped bends of another ribbon layer according to the orientation of said insulator blocks with respect to said frame.

8. A resistor according to claim 6 wherein said insulator blocks are eccentrically attached to said inner and outer frame portions.

9. A resistor according to claim 6 wherein said support means is eccentrically attached to said insulator blocks.

10. A resistor according to claim 4 wherein said holding portions further comprise means for adjusting the radial distance between said inner and outer annular portions.

11. An annular resistor assembly comprising:

a plurality of like, arcuate inner and outer spaced frame members connected at their ends by a pair of straight members to form a segment of an annulus;

insulators secured to the opposing faces of said inner and outer spaced frame members;

a reflexed resistance ribbon means having inner and outer U-shaped bends in proximity to said insulators and segments connecting and arranged in a radial relation between said inner and outer bends;

support means secured to said insulators and providing individual support for each of said bends; and terminal means connected to said ribbon means for connecting the latter to a source of electrical current.

12. An annular resistor assembly according to claim 11 wherein said ribbon means of each said resistor unit comprises a plurality of ribbon layers, each layer forming a segment of an annulus concentric to said inner arcuate frame members, and said insulating means comprises a plurality of rows of insulator blocks, one row for each layer.

13. An annular resistor assembly according to claim 12 comprising eccentric mounting means whereby the U-shaped bends of one ribbon layer may be selectively aligned with or offset from the U-shaped bends of another ribbon layer according to the orientation of said insulator blocks with respect to said frame.

14. An annular resistor assembly according to claim 12 wherein said insulator blocks are eccentrically attached to said inner and outer frame members.

15. An annular resistor assembly according to claim 12 wherein said support means is eccentrically attached to said insulator blocks.

16. An annular resistor assembly according to claim 11 wherein said straight members further comprise means for adjusting the radial distance between said inner and outer spaced frame members.

17. A resistor according to claim 4 further comprising air turbulators having portions conformed to and fitted over said U-shaped bends and portions extending generally transversely therefrom.

18. A resistor according to claim 4 wherein said U-shaped bends of said ribbon means have air turbulation means formed therein.

19. A resistor according to claim 4 wherein said segments of said ribbon means have convolutions formed therein.

20. A resistor according to claim 4 wherein said support means comprises a plurality of pins and wherein each of said U-shaped bends has one or more apertures therein for loosely receiving a corresponding pin, each of said pins having a shoulder portion wider than said aperture to keep said U-shaped bends spaced from said insulating means.

21. A resistor according to claim 20 wherein said insulating means comprises a plurality of insulator blocks, each block having four of said pins attached thereto, and wherein each of said U-shaped bends has two said apertures whereby each of said blocks supports two of said U-shaped bends.

* * * * *